US005593149A

United States Patent [19]

Kimura et al.

[11] Patent Number: 5,593,149

[45] Date of Patent: Jan. 14, 1997

[54] AUTOMATIC TELLER MACHINE MANAGING SYSTEM

[75] Inventors: Haruo Kimura; Isao Miyake; Toshihiro Nakano; Yukihiro Nemoto, all of Tokyo, Japan

[73] Assignee: Oki Electric Industry Co., Ltd., Tokyo, Japan

[21] Appl. No.: 369,937

[22] Filed: Jan. 9, 1995

[30] Foreign Application Priority Data

Jan. 13, 1994 [JP] Japan ..... 6-002111
Nov. 22, 1994 [JP] Japan ..... 6-312583

[51] Int. Cl.[6] ..... B65H 5/02

[52] U.S. Cl. ..... 271/3.01; 235/379; 414/789.7; 902/17; 902/36

[58] Field of Search ..... 235/379; 902/17, 902/32, 36; 271/3.01; 414/789.7

[56] References Cited

U.S. PATENT DOCUMENTS 4,436,182 3/1984 Simonotti et al. ..... 902/17 X
4,866,254 9/1989 Okayama et al. ..... 902/17 X
5,152,512 10/1992 Yoshida et al. ..... 235/379 X

FOREIGN PATENT DOCUMENTS 2-278397 11/1990 Japan .
5-2355 1/1993 Japan .
6-73150 9/1994 Japan .

*Primary Examiner*—Karen B. Merritt
*Assistant Examiner*—Janice L. Krizek
*Attorney, Agent, or Firm*—Law Office of Steven M. Rabin

[57] ABSTRACT

An automatic teller machine managing system includes an automatic teller machine and a carrier for exchanging a medium, such as, paper money, with the automatic teller machine. The system further includes a mechanism for moving the carrier relative to the automatic teller machine, and a coupling unit which is movably arranged and couples the carrier and the automatic teller machine with each other. In the system, the medium is carried one by one, via the coupling unit, from the carrier to the automatic teller machine or from the automatic teller machine to the carrier.

16 Claims, 14 Drawing Sheets

AUTOMATIC TELLER MACHINE MANAGING SYSTEM

CROSS-REFERENCE TO RELATED APPLICATION

This application claims the priority benefits of Japanese application Nos. 002111/1994, filed Jan. 13, 1994 and 312583/1994, filed Nov. 22, 1994, the entire disclosures of which are incorporated herein by reference.

BACKGROUND OF THE INVENTION

1. Field of the Invention

The present invention relates to an automatic teller machine managing system having automatic teller machines (ATMs) installed in a bank or the like for automatically dealing with a medium, such as, paper money, and a carrier for performing medium management for the ATMs.

2. Description of the Related Art

Recently, for improving the service to customers in light of reducing labor and shortening handling time, ATM managing systems have been proposed which, for example, automatically supply or recover a transaction medium, such as, paper money when paper money is short or excess in the ATM.

One of those ATM managing systems is disclosed in Japanese Patent Application No. 5-2355. In the disclosed system, cassettes containing paper money are kept on a cassette shelf. When information is received from the ATM that paper money is lacking, a self-mobile carrier recovers an empty cassette from the ATM to keep it on the cassette shelf and carries a cassette filled with paper money from the cassette shelf to the ATM for supplying paper money on a cassette basis.

On the other hand, since the cassette itself has no means for monitoring to ascertain an amount of paper money, the ATM is used to ascertain the amount of paper money when occasion arises.

SUMMARY OF THE INVENTION

It is an object of the present invention to provide an automatic teller machine managing system having an automatic teller machine (ATM) and a carrier for exchanging a medium with the ATM, wherein supply and recovery of the medium are effectively performed.

It is another object of the present invention to reliably connect and disconnect a conveying portion between the ATM and the carrier where the medium is conveyed between the ATM and the carrier.

It is another object of the present invention to easily detect an amount of the medium held in the carrier which supplies and recovers the medium.

In order to accomplish the foregoing objects, according to one aspect of the present invention, an automatic teller machine managing system includes coupling means movably arranged and connecting between a carrier and an automatic teller machine and carrying means for carrying a medium one by one, via the coupling means, from the carrier to the automatic teller machine or from the automatic teller machine to the carrier. Further, a mechanism for positioning a conveying passage and/or means for carrying the medium in a supply medium accumulating section and a recovery medium accumulating section and for detecting an amount of the medium may be further provided.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, an automatic teller machine (ATM) managing system according to a first preferred embodiment of the present invention will be described hereinbelow with reference to FIGS. 1 to 9. In the figures, the same or like elements are assigned the same reference symbols.

STRUCTURE OF SYSTEM

Figure 1:
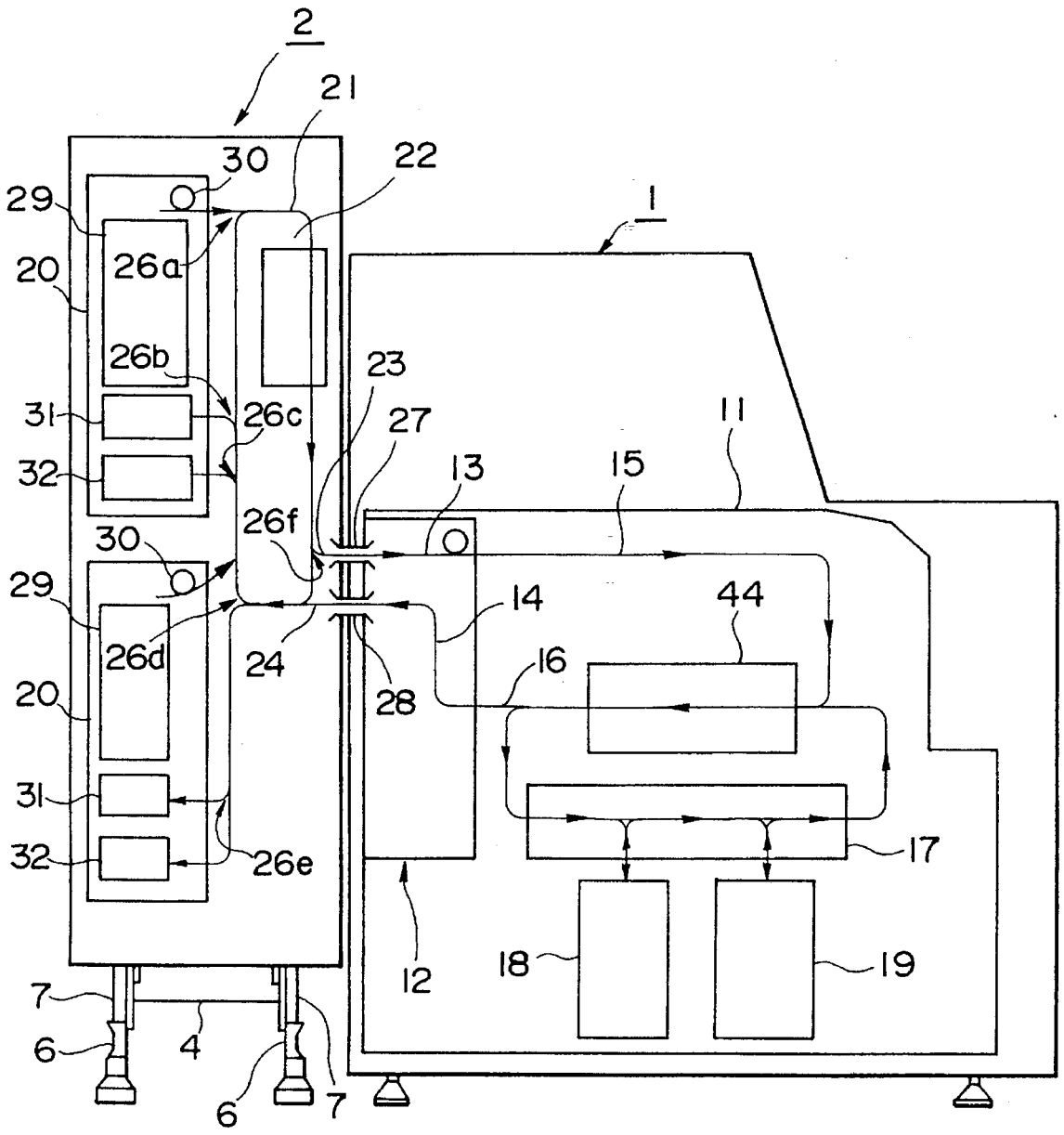
FIG. 1 is a schematic diagram showing the main structure of an automatic teller machine managing system according to a first preferred embodiment of the present invention, wherein the system is seen from a lateral side thereof.
Figure 2:
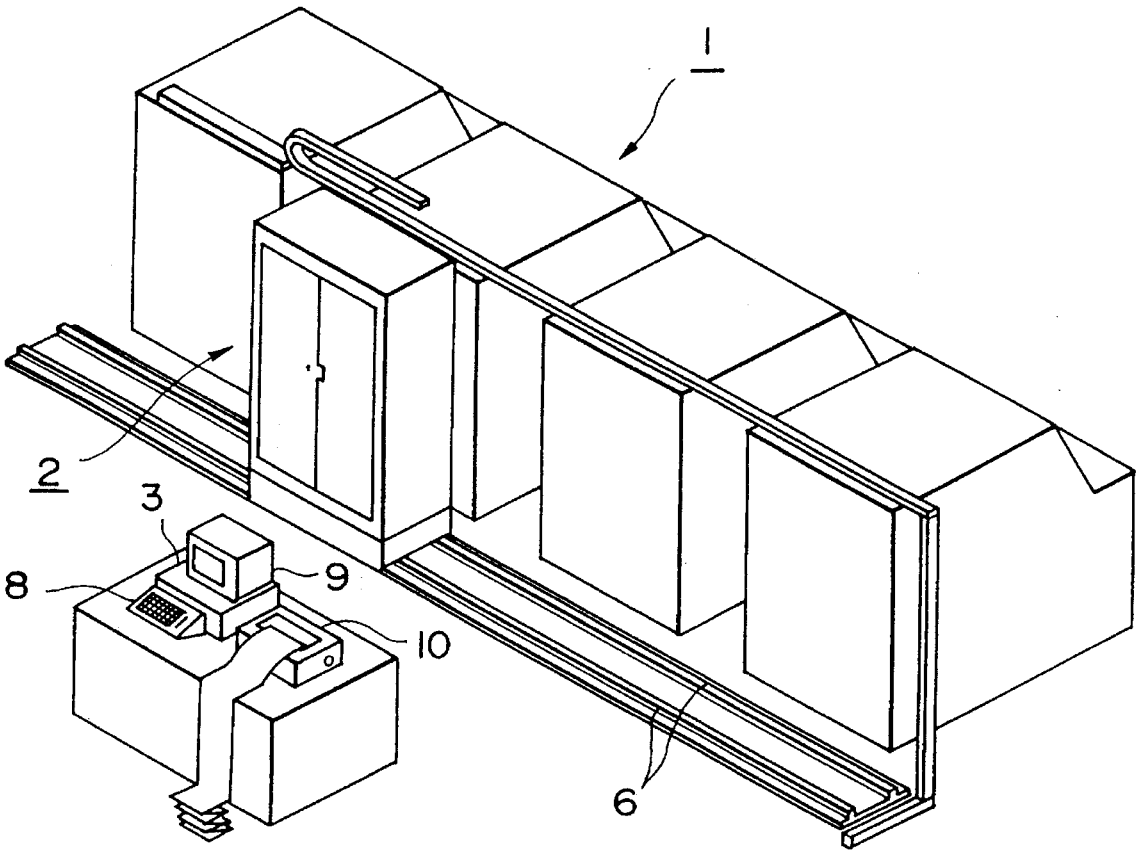
FIG. 2 is a perspective view showing the automatic teller machine managing system according to the first preferred embodiment.
Figure 3:
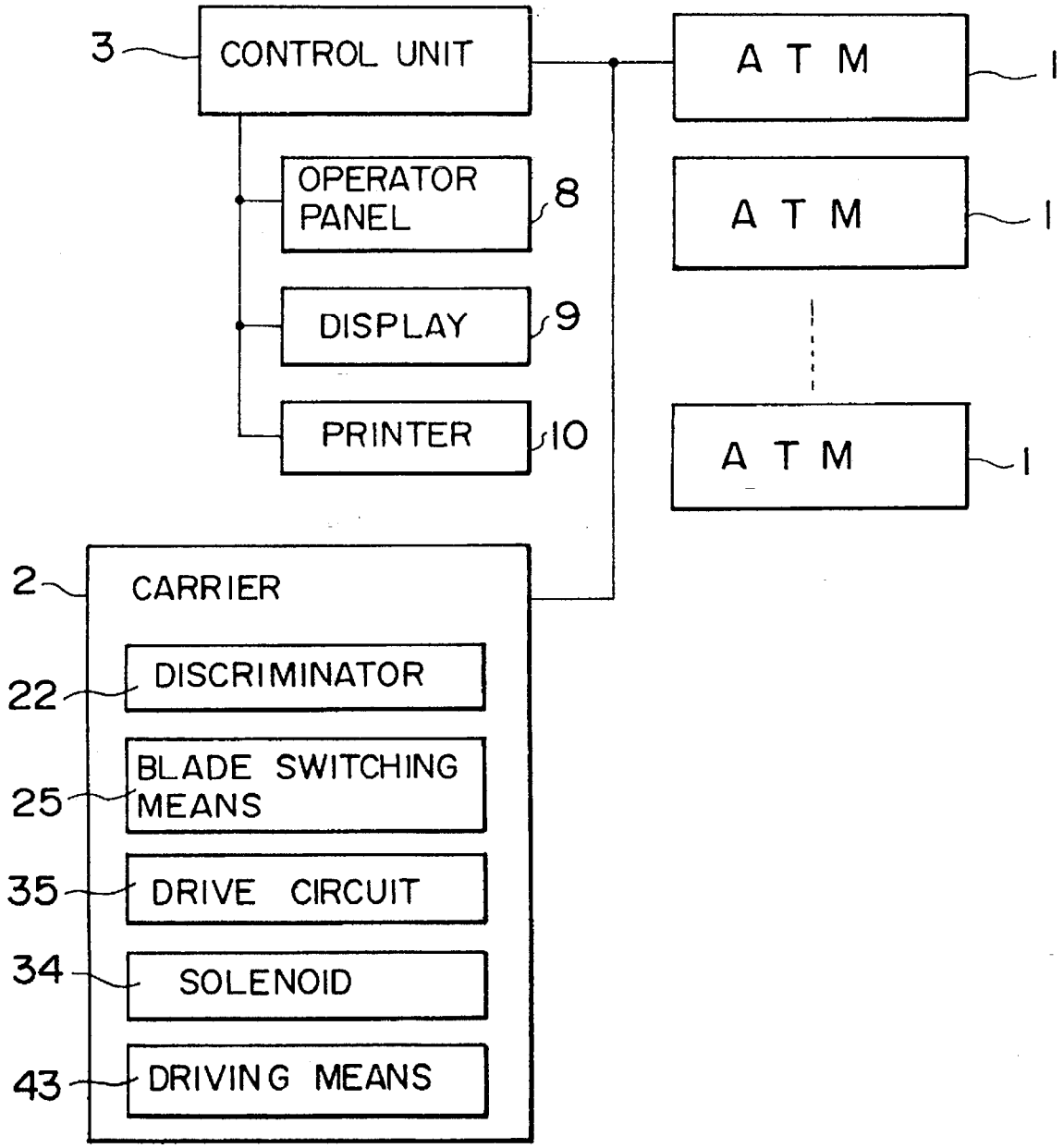
FIG. 3 is a block diagram of the automatic teller machine managing system according to the first preferred embodiment.

FIG. 1 is a schematic diagram showing the main structure of the ATM managing system as seen from a lateral side thereof, FIG. 2 is a perspective view of the ATM managing system, and FIG. 3 is a block diagram of the ATM managing system shown in FIG. 2.

In FIG. 1, at the back of a plurality of automatic teller machines (ATMs) 1 installed in a bank is provided a carrier 2 movable between the ATMs 1 and a centralized control unit 3 for controlling movement of the carrier 2 and others based on information from the ATMs 1.

The carrier 2 is equipped with driving means 4, such as, a drive motor, so as to move along rails 6 with wheels 7 thereon as shown in FIG. 1. The control unit 3 is provided with an operator panel 8, a display 9 and a printer 10. As described later in detail, the control unit 3, in response to a notice from an arbitrary one of the ATMs 1, moves the carrier 2 to a predetermined position relative to the ATM 1 giving the notice and allows supply or recovery of paper money between the ATM 1 and the carrier 2. On the other hand, by operating the operator panel 8 at the control unit 3, the carrier 2 can also be moved to a given position relative to an arbitrary one of the ATMs 1 so as to supply or recover paper money to or from the ATM 1. The control unit 3 is further capable of displaying, such as, a result of calculation of an amount of paper money held in the carrier 2 and outputting it to the printer 10.

In the ATM 1, as shown in, such as, Japanese First (unexamined) Patent Publication No. 2-278397, a paper money in-and-out device 11 is disposed for handling paper money for supply and paper money for recovery (hereinafter referred to as "supply paper money" and "recovery paper money", respectively) via a supply-recovery unit. In this preferred embodiment, an adapter 12, which corresponds to the supply-recovery unit, is arranged at a rear end of the ATM 1. The adapter 12 and the paper money in-and-out device 11 have conveying passages 13, 15 for carrying supply paper money, and conveying passages 14, 16 for carrying recovery paper money.

The conveying passage 15 conveys supply paper money to cashbox 18 or 19 via an in-and-out unit 17 where supply paper money is classified per kind of paper money, that is, into a 1,000-yen or 10,000-yen bill for the cash box 18 or 19. On the other hand, the conveying passage 16 conveys a given amount of recovery paper money from the cashbox 18 or 19 via the in-and-out unit 17 when the cashbox 18 or 19 is full.

In the carrier 2, a plurality of containers 20 are arranged for keeping paper money therein. In FIG. 1, a pair of the containers 20 are arranged vertically in the carrier 2. The carrier 2 further includes therein, such as, a circulating conveying passage 21, a discriminator 22 for discriminating a kind, obverse-reverse, true-false, the number and the like of paper money, a diverging portion 23 where supply paper money diverges from the circulating conveying passage 21, a joining portion 24 where recovery paper money joins the circulating conveying passage 21, blades 26*a* to 26*f*, blade switching means 25 (see FIG. 3) for switching directions of the blades, a guide plate 27 coupled between the carrier 2 and the ATM 1 for carrying supply paper money therethrough, and a guide plate 28 coupled between the carrier 2 and the ATM 1 for carrying recovery paper money therethrough.

In each of the containers 20, an accumulating section 29 for accumulating supply paper money, feed-out means 30 for feeding out supply paper money from the accumulating section 29, an accumulating section 31 for accumulating recovery paper money recovered from the ATM 1, and an accumulating section 32 for accumulating reject paper money which was rejected by the discriminator 22 as being disqualified for supply paper money. Detailed structures and operations of the accumulating sections 29, 31 and 32 are disclosed in Japanese Second (examined) Patent Publication No. 6-73150, and will be described later with reference to FIGS. 9A and 9B.

Figure 4:
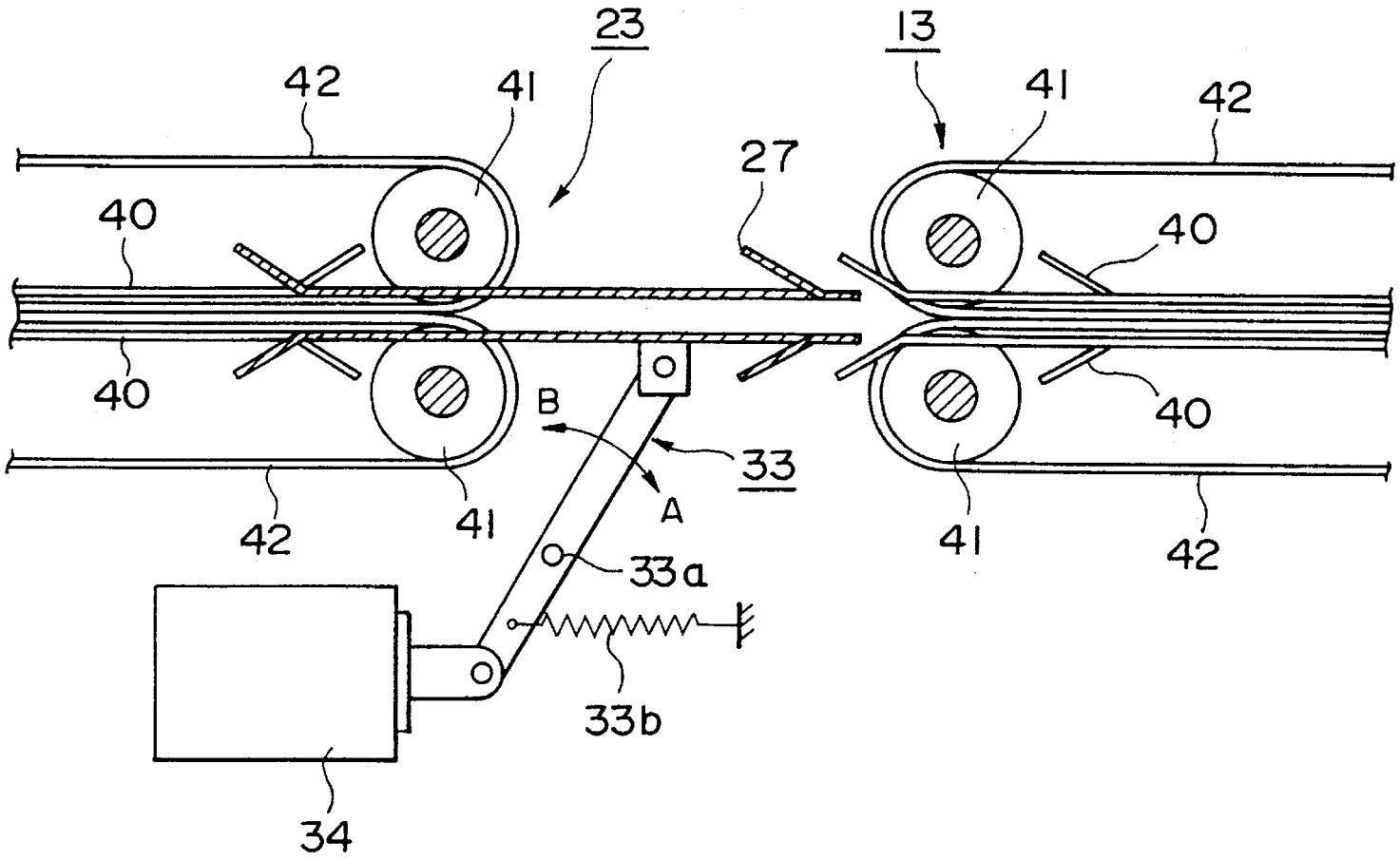
FIG. 4 is a schematic sectional view showing coupling means between an automatic teller machine and a carrier according to the first preferred embodiment.
Figure 5:
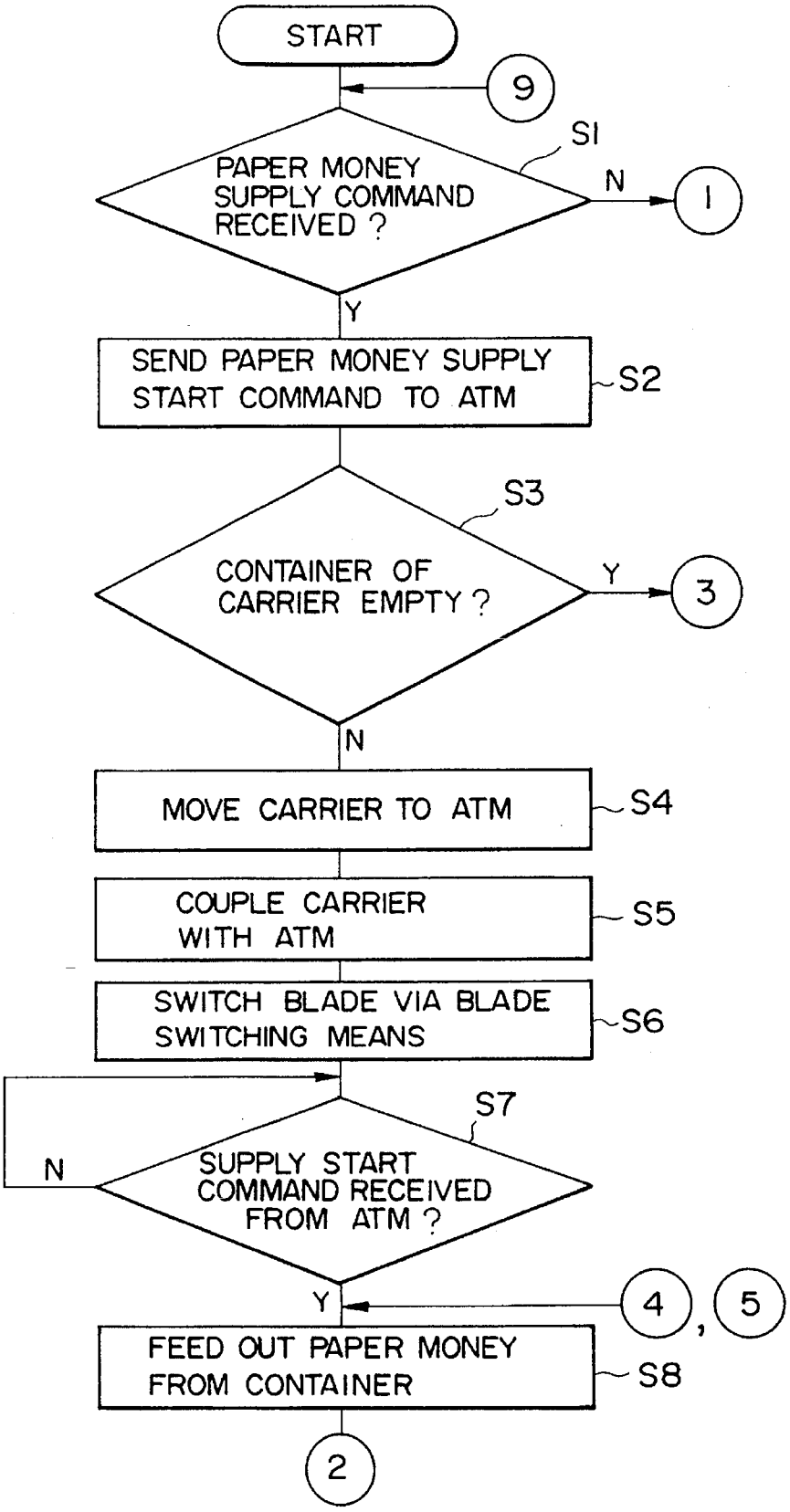
FIGS. 5 to 8 show a flowchart of a paper money supply-recovery routine representing an operation of the automatic teller machine managing system according to the first preferred embodiment.
Figure 6:
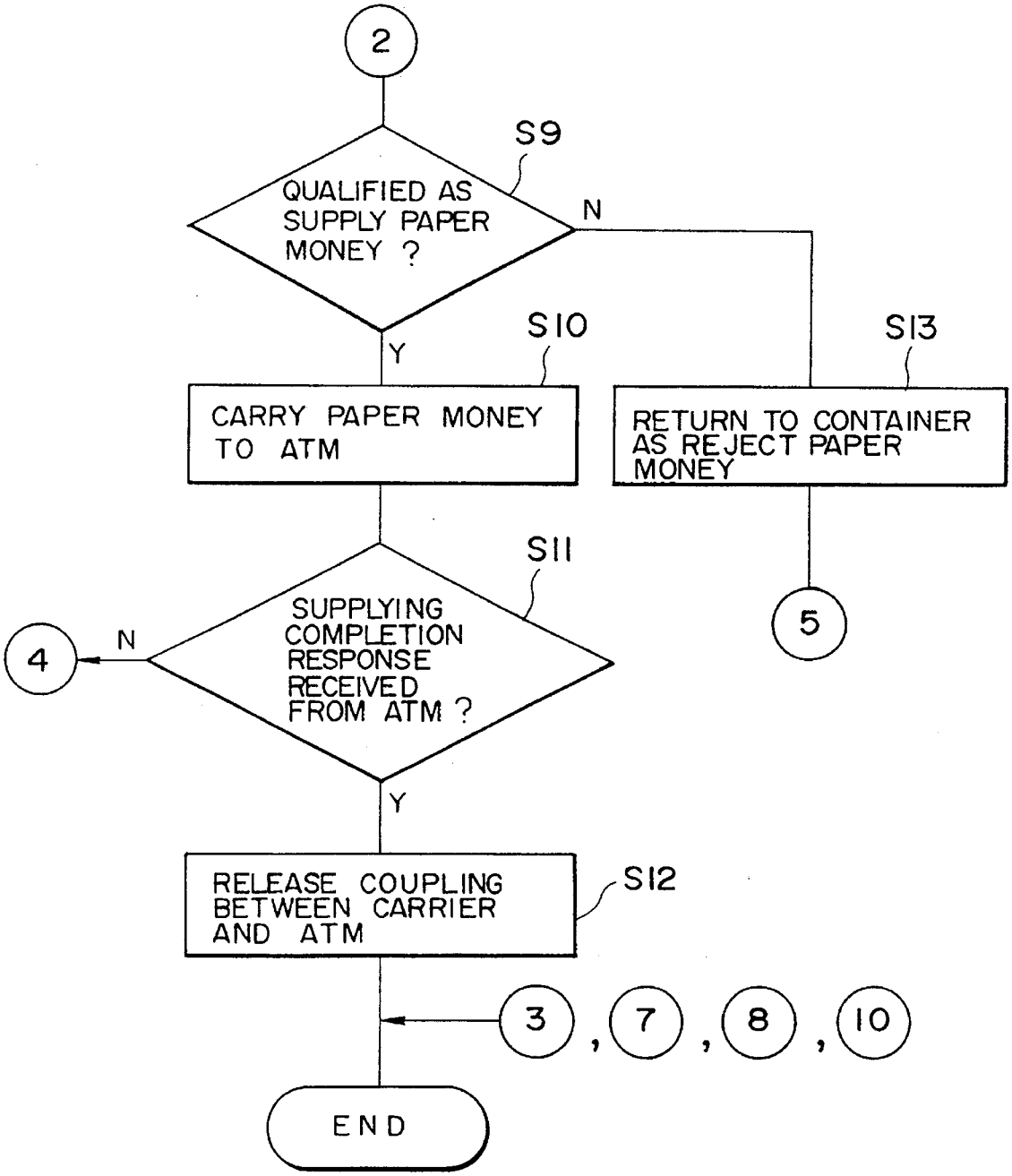
Figure 7:
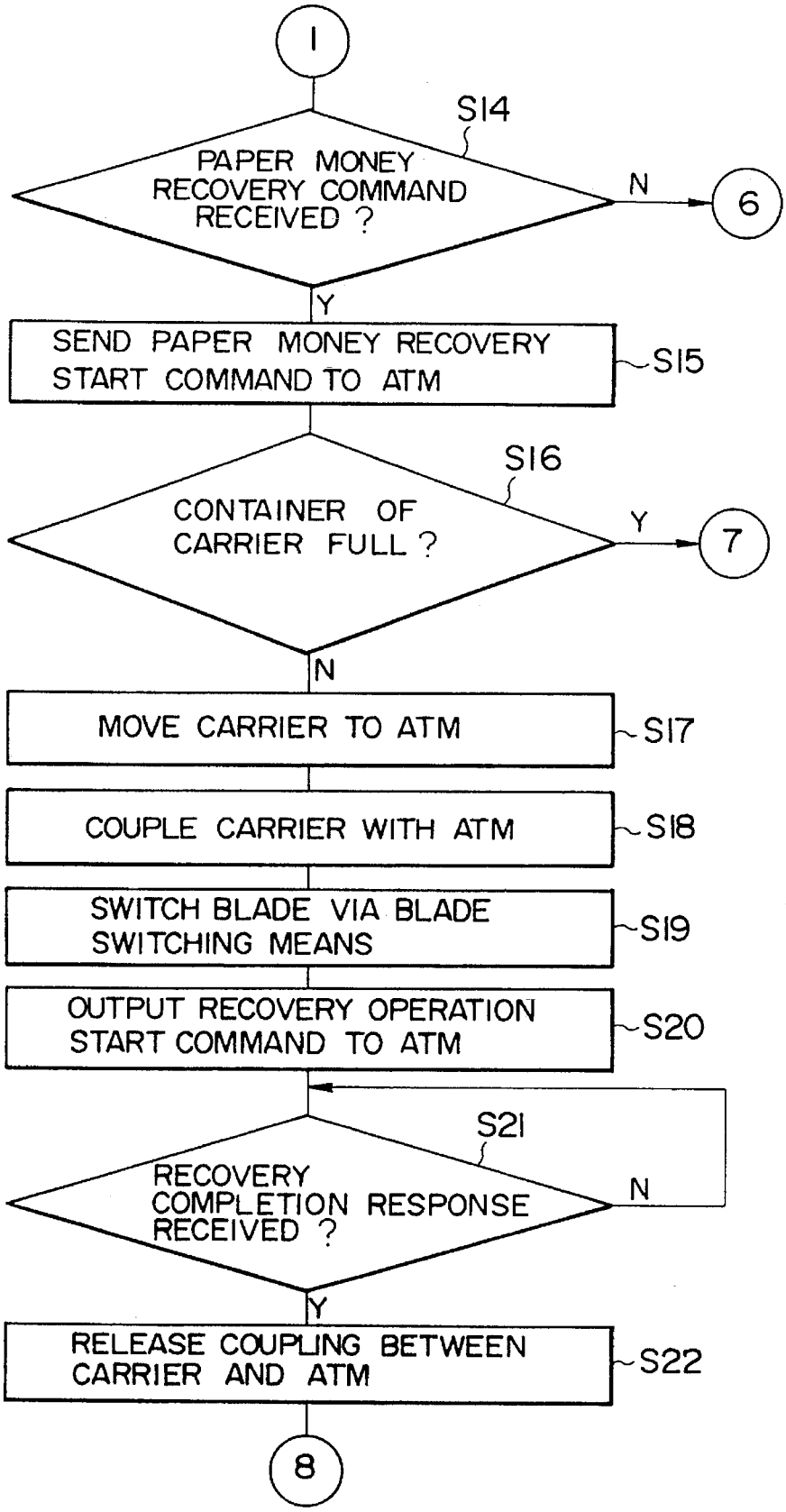
Figure 8:
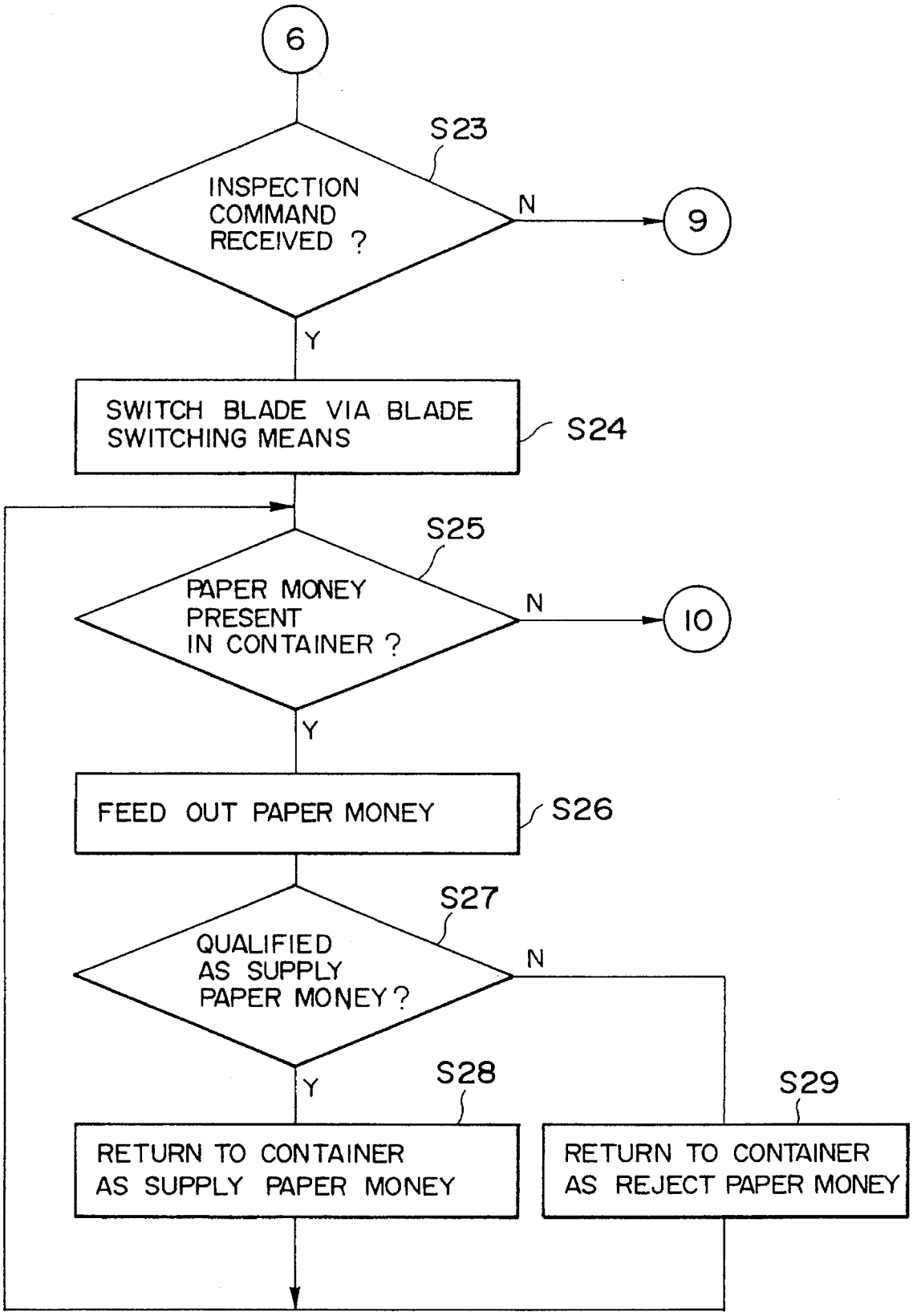

The conveying passages 13, 14, the circulating conveying passage 21, the diverging portion 23 and the joining portion 24 are constituted by guide members 40, feed rollers 41, and belts 42, such as, pulse motors, as appreciated from FIG. 4. To the circulating conveying passage 21 are connected the feed-out means 30 and the accumulating sections 31, 32 of the containers 20 and the diverging portion 23 via the blades 26*a* to 26*f*. Further, the discriminator 22 is provided along the circulating conveying passage 21. As shown in FIG. 3, the discriminator 22, the blade switching means 25 and the driving means 43 are provided in the carrier 2 and controlled by a control unit (not shown) of the carrier 2.

Further, the blade switching means 25 is constituted by, such as, electromagnetic solenoids (not shown) and controlled by the control unit (not shown) of the carrier 2 to switch the blades 26*a* to 26*f* for supplying or recovering paper money.

FIG. 4 is a schematic sectional view showing the coupling means between the ATM 1 and the carrier 2 according to the first preferred embodiment.

As shown in FIG. 4, the guide plate 27 is provided with a linkage 33 pivotally supported about a shaft 33*a* and an electromagnetic solenoid 34. The linkage 33 has one end which is rotatably connected to the guide plate 27, and the other end which is rotatably connected to a core of the solenoid 34. The solenoid 34 is selectively energized and deenergized via a drive circuit 35 which is controlled by the control unit (not shown) of the carrier 2. When the solenoid 34 is energized, the linkage 33 turns about the shaft 33*a* in a direction A against a biasing force of a spring 33*b* to displace the guide plate 27 rightward in FIG. 4 so that the diverging portion 23 of the carrier 2 is coupled with the conveying passage 13 of the adapter 12. On the other hand, when the solenoid 34 is deenergized, the linkage 33 turns in a direction B due to the biasing force of the spring 33*b* so as to separate the guide plate 27 from the conveying passage 13.

The guide plate 28 and the associated elements are substantially the same in structure as the foregoing guide plate 27 and associated elements.

Another preferred embodiment of the coupling means between the ATM 1 and the carrier 2 will be described later in detail.

OPERATION OF SYSTEM

Now, an operation of the ATM managing system will be described hereinbelow.

FIGS. 5 to 8 show a flowchart of a paper money supply-recovery routine representing the operation of the ATM managing system according to the first preferred embodiment. The ATM managing system has been finished with a start-up operation and is now in the normal operating condition.

At step S1, the control unit 3 checks whether a paper money supply command is received from the ATM 1. If answer at step S1 is positive, the routine proceeds to step S2.

On the other hand, if answer at step S1 is negative, the routine proceeds to step S14. The paper money in-and-out device 11 of the ATM 1 monitors the cashboxes 18, 19 using sensors and checks whether paper money in the cashbox 18 or 19 runs short soon. If the sensor detects this lacking condition, the ATM 1 sends the paper money supply command and a kind of supply paper money to the control unit 3.

At step S2, the control unit 3 sends a paper money supply start command to the ATM 1 in response to a positive answer at step S1.

Subsequently, at step S3, the control unit 3 checks whether the containers 20 are empty. If answer at step S3 is positive, then the routine is terminated. On the other hand, if answer at step S3 is negative, the routine proceeds to step S4.

At step S4, the control unit 3 moves the carrier 2 to a given position behind the ATM 1 which has outputted the paper money supply command to the control unit 3.

Subsequently, at step S5, the control unit (not shown) of the carrier 2 energizes the solenoid 34 to couple the guide plate 27 with the conveying passage 13 of the adapter 12 so that the ATM 1 and the carrier 2 are connected to each other.

Subsequently, at step S6, the control unit (not shown) of the carrier 2 switches the blades 26*a* to 26*f* via the blade switching means 25.

Subsequently, at step S7, the control unit 3 checks whether a supply start command is received from the ATM 1. In response to receipt of the paper money supply start command from the control unit 3 (see step S2), the ATM 1 outputs a supply start command to the paper money in-and-out device 11. In response to the supply start command from the ATM 1, the paper money in-and-out device 11 switches its internal mode to a supply mode to start a supply operation. In response to this, the ATM 1 outputs the supply start command to the control unit 3.

If answer at step S7 is negative, step S7 is repeated until answer at step S7 becomes positive. On the other hand, if answer at step S7 is positive, the routine proceeds to step S8.

At step S8, the control unit (not shown) of the carrier 2 drives the feed rollers of the circulating conveying passage 21 and feeds out supply paper money stored in the container 20 onto the circulating conveying passage 21 via the feed-out means 30.

Subsequently, at step S9, the control unit (not shown) of the carrier 2 checks via the discriminator 22 whether supply paper money fed out from the container 20 can be used as supply paper money. If answer at step S9 is positive, the routine proceeds to step S10. On the other hand, if answer at step S9 is negative, the routine proceeds to step S13.

At step S10, the carrier conveys supply paper money to the ATM 1 one by one.

Subsequently, at step S11, the control unit 3 checks whether a supplying completion response is received from the ATM 1. If answer at step S11 is positive, the routine proceeds to step S12. On the other hand, if answer at step S11 is negative, the routine returns to step S8. The ATM 1 puts a 1,000-yen or 10,000-yen bill into the cashbox 18 or 19 via the in-and-out unit 17. The paper money in-and-out device 11 executes calculation based on outputs from the discriminator 22 so as to determine whether the required number of paper money has been supplied to the cashbox 18 or 19. If positive, the ATM 1 sends the supplying completion response along with data indicative of the supplied number of paper money to the control unit 3.

At step S12, the control unit (not shown) of the carrier 2 deenergizes the solenoid 34 to separate the guide plate 27 from the conveying passage 13 of the adapter 12 so that the coupling between the ATM 1 and the carrier 2 is released and the routine is terminated.

On the other hand, at step S13, the control unit (not shown) of the carrier 2 switches the blades 26*a* to 26*f* via the blade switching means 25 so as to return disqualified paper money to the accumulating section 32 of the container 20 as reject paper money. From step S13, the routine returns to step S8.

Now, referring back to step S14, the control unit 3 checks whether a paper money recovery command is received from the ATM 1. If answer at step S14 is positive, the routine proceeds to step S15. On the other hand, if answer at step S14 is negative, the routine proceeds to step S23. The paper money in-and-out device 11 of the ATM 1 monitors the cashboxes 18, 19 using the sensors and checks whether the cashbox 18 or 19 is full of paper money. If the sensor detects this full condition, the ATM 1 sends the paper money recovery command to the control unit 3.

At step S15, the control unit 3 sends a paper money recovery start command to the ATM 1 in response to a positive answer at step S14.

Subsequently, at step S16, the control unit 3 checks whether the containers 20 are full. If answer at step S16 is positive, then the routine is terminated as determining that recovery paper money can not be stored any more. On the other hand, if answer at step S16 is negative, the routine proceeds to step S17.

At step S17, the control unit 3 moves the carrier 2 to a given position behind the ATM 1 which has outputted the paper money recovery command to the control unit 3.

Subsequently, at step S18, the control unit (not shown) of the carrier 2 energizes the solenoid 34 to couple the guide plate 28 with the conveying passage 14 of the adapter 12 so that the ATM 1 and the carrier 2 are connected to each other.

Subsequently, at step S19, the control unit (not shown) of the carrier 2 switches the blades 26*a* to 26*f* via the blade switching means 25.

Subsequently, at step S20, the control unit 3 outputs a recovery start command to the ATM 1. In response to this, the ATM 1 outputs a recovery start command to the paper money in-and-out device 11. In response to this, the paper money in-and-out device 11 switches its internal mode to a recovery mode to start a recovery operation. Recovery paper money is discriminated by a discriminator 44 in the paper money in-and-out device 11 and then taken into the accumulating section 31 of the container 20 of the carrier 2.

Subsequently, at step S21, the control unit 3 checks whether a recovery completion response is received from the ATM 1. If answer at step S21 is positive, the routine proceeds to step S22. On the other hand, if answer at step S21 is negative, step S21 is repeated until answer at step S21 becomes positive. When the preset number of recovery paper money is sent out, the ATM 1 sends the recovery completion response along with data indicative of the sent-out number of recovery paper money to the control unit 3.

At step S22, the control unit (not shown) of the carrier 2 deenergizes the solenoid 34 to separate the guide plate 28 from the conveying passage 14 of the adapter 12 so that the coupling between the ATM 1 and the carrier 2 is released and the routine is terminated.

It is to be appreciated that, when a paper money supply command or a paper money recovery command is inputted by an operator using the operator panel 8 of the control unit 3, the same routine as described above is executed.

Referring back to step S23, the control unit 3 checks whether an inspection command indicative of an instruction for ascertaining an amount of paper money in the carrier 2 is received from the operator panel 8. If the answer at step S23 is positive, the routine proceeds to step S24. On the other hand, if answer at step S23 is negative, the routine returns to step S1.

At step S24, the control unit (not shown) of the carrier 2 switches the blades 26*a* to 26*f* via the blade switching means 25.

Subsequently, at step S25, the control unit 3 checks using sensors whether paper money to be inspected is present in the containers 20 of the carrier 2. If answer at step S25 is positive, the routine proceeds to step S26. On the other hand, if answer at step S25 is negative, the routine is terminated.

At step S26, the control unit (not shown) of the carrier 2 drives the circulating conveying passage 21 and the feed-out means to feed out paper money contained in the container 20.

Subsequently, at step S27, the control unit 3 discriminates fed-out paper money via the discriminator 22 to see whether fed-out paper money is qualified or can be used as supply paper money. If answer at step S27 is positive, the routine proceeds to step S28. On the other hand, if answer at step S27 is negative, the routine proceeds to step S29.

At step S28, the control unit (not shown) of the carrier 2 brings qualified paper money into the accumulating section 31 of the container 20 so as to be separated from non-discriminated paper money in the accumulating section 29. From step S28, the routine returns to step S25.

On the other hand, at step S29, the control unit (not shown) of the carrier 2 switches the blades 26*a* to 26*f* via the blade switching means 25 so as to bring disqualified paper money into the accumulating section 32 so as to be separated from recovery paper money stored in the accumulating section 31.

STRUCTURE OF PAPER MONEY CONTAINER

Figure 9A:
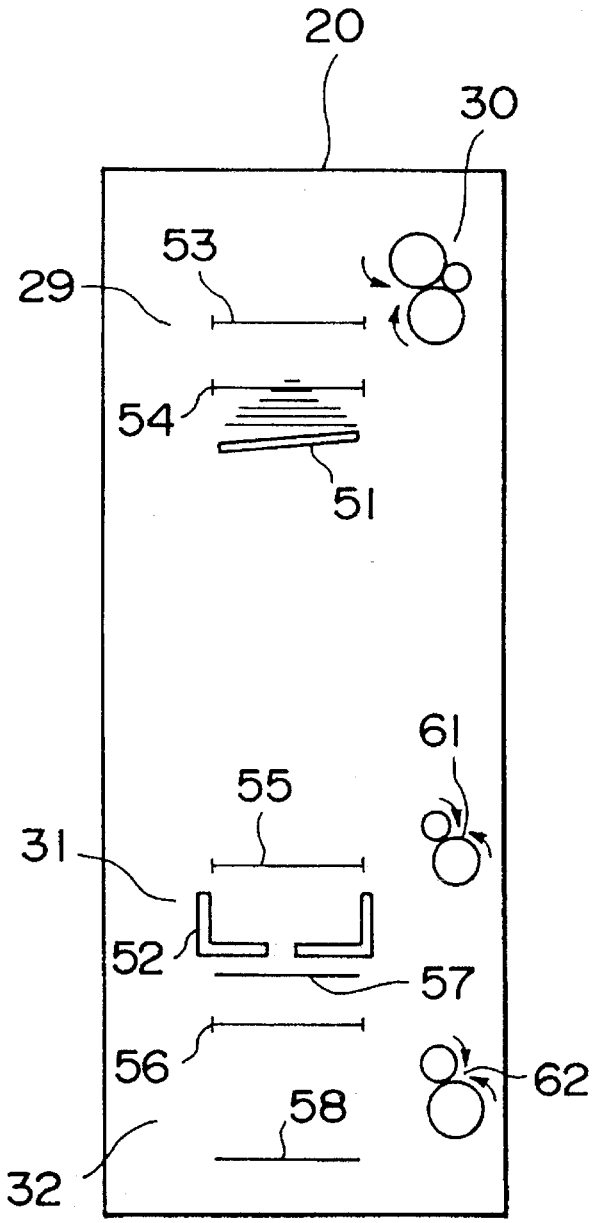
FIG. 9A is a longitudinal sectional view showing a paper money container in a normal operating state according to the first preferred embodiment.
Figure 9B:
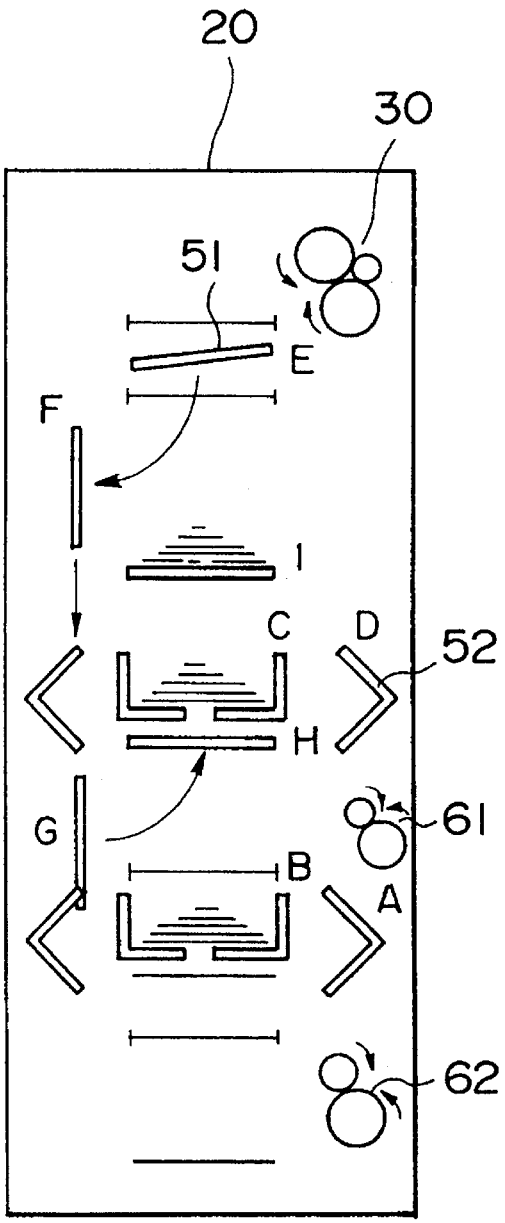
FIG. 9B is a diagram for explaining an operation of the paper money container shown in FIG. 9A when recovery paper money is transferred from one accumulating section to another accumulating section in the paper money container.

FIG. 9A is a longitudinal sectional view of the container 20 in a normal operating state, and FIG. 9B is a longitudinal sectional view of the container for explaining an operation when recovery paper money stored in the accumulating section 31 is transferred to the accumulating section 29.

As shown in the figures, the container 20 is provided with the accumulating section 29 for accumulating supply paper money, the accumulating section 31 for accumulating recovery paper money and the accumulating section 32 for accumulating reject paper money. At an outlet of the accumulating section 29, the feed-out means 30 in the form of a combination of rollers is provided. On the other hand, a stage 51 is provided at the center of the accumulating section 29 for accumulating paper money thereon. Further, sensors 53, 54 and 55 are provided for monitoring an amount of paper money accumulated on the stage 51. Specifically, the sensor 53 detects that no paper money is present in the accumulating section 29, the sensor 54 detects that paper money runs short soon in the accumulating section 29, and the sensor 55 detects that the accumulating section 29 is full of paper money.

The stage 51 is arranged to move vertically in the container 20 such that a position of the stage 51 becomes lower as an amount of paper money on the stage 51 increases. It is arranged that the stage 51 intercepts light to one of the sensors 53 to 55 when the stage 51 is located at a corresponding vertical position, which is convened into an electric signal by the corresponding sensor.

The accumulating section 31 is provided with take-in means 61 in the form of a combination of rollers for taking in recovery paper money. Taken-in recovery paper money is accumulated on a pair of clamps 52 each having an L-shape in cross section, and transferred onto the stage 51 per predetermined timing. The accumulating section 32 is provided with take-in means 62 in the form of a combination of rollers for taking in reject paper money. As described before, paper money determined by the discriminator 22 to be non-usable as supply paper money is accumulated on a plate 58 via the take-in means 62. Above the plate 58 is disposed a sensor 56 for detecting that reject paper money is full on the plate 58. Further, above the sensor 56 is arranged a partition plate 57 for supporting recovery paper money along with the clamps 52.

For feeding out paper money from the container 20, the feed-out means 30 is driven so as to feed out paper money on the stage 51 one by one.

On the other hand, for transferring recovery paper money in the accumulating section 31 to the accumulating section 29 for using as supply paper money, an operation as shown in FIG. 9B is performed.

First, as shown in FIG. 9B, the clamps 52 are set to a state B from a state A. When paper money is accumulated thereon, the clamps 52 are increased to a state C. Thereafter, when paper money is transferred onto the stage 51, the clamps 52 are set to a state D and then lowered to be set to the state A again.

On the other hand, the stage 51 is moved, when paper money is accumulated on the clamps 52, to be set to a state F from a state E and then lowered to a state G. Subsequently, after the clamps 52 are increased to the state C from the state B, the stage 51 is set to a state H positioned below the clamps 52. The clamps 52 are then released to the state D so that paper money on the clamps 52 are transferred onto the stage 51. Thereafter, the stage 51 in the state H is increased to a state I. A moving distance from the state H to the state I depends on an amount of paper money on the stage 51.

As described above, paper money is fed out via the feed-out means 30 or taken in via the take-in means 61. When supplying paper money the ATM 1, paper money in the accumulating section 29 is discriminated so that paper money qualified as supply paper money is carried to the ATM 1, while paper money disqualified for supply paper money is accumulated in the accumulating section 32.

When it is desired to derive an amount of paper money in the container 20, paper money accumulated in the accumulating section 31 is transferred to the accumulating section 29 in the foregoing manner, and then paper money is fed out from the accumulating section 29 and discriminated by the discriminator 22 so as to be accumulated in the accumulating section 31 or 32.

In this manner, the calculation of the paper money amount is performed while separating discriminated paper money from non-discriminated paper money and further separating qualified paper money from disqualified paper money.

POSITIONING OF COUPLING MEANS AND DETECTION OF COUPLING

Figure 10:
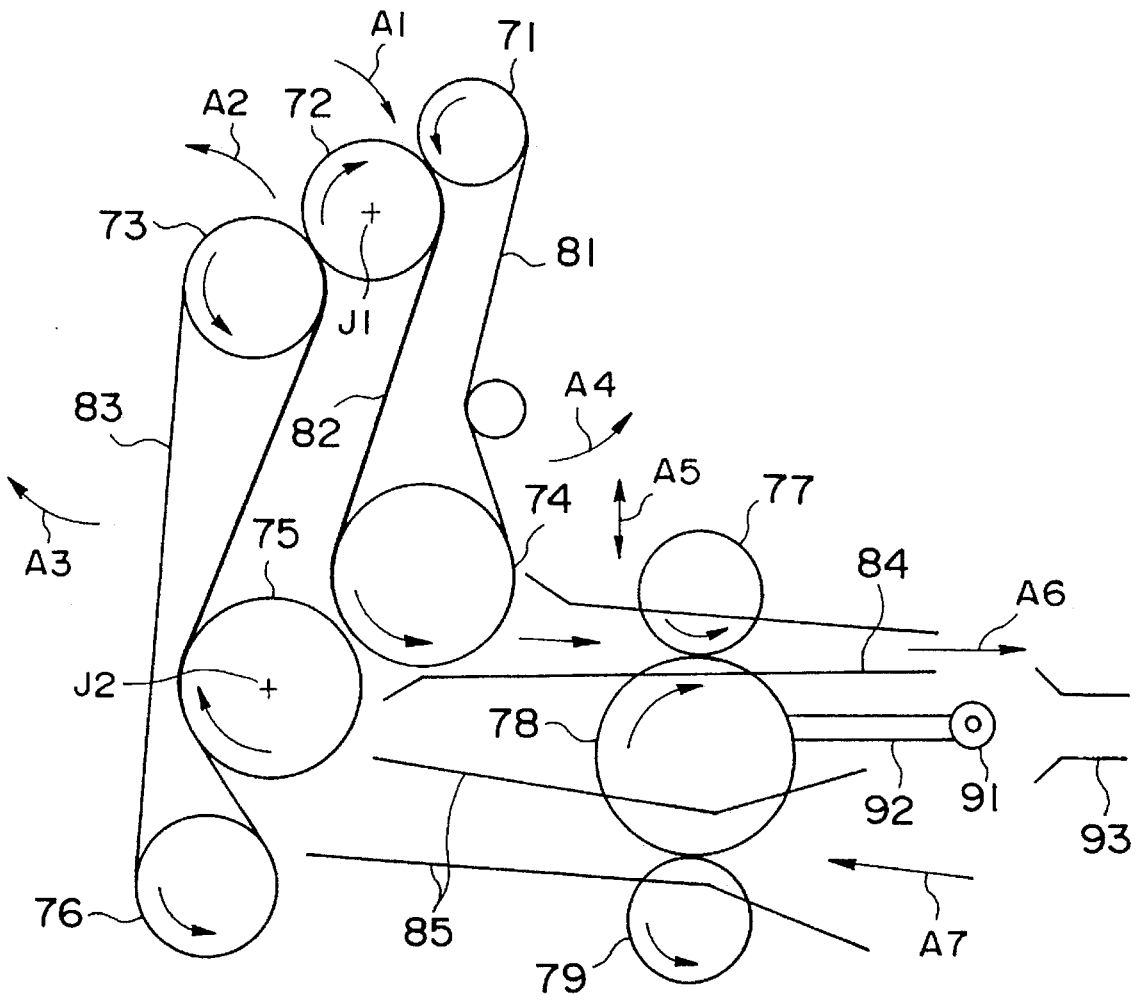
FIG. 10 is a side view showing coupling means between an automatic teller machine and a carrier according to a second preferred embodiment of the present invention.

FIG. 10 is a side view showing coupling means according to a second preferred embodiment of the present invention.

In FIG. 10, a pair of rollers 71, 74, a pair of rollers 72, 75 and a pair of rollers 73, 76 have their own belts 81, 82 and 83 held thereon, respectively, and are rotated in directions as shown by corresponding arrows in the figure. With this arrangement, paper money is carried in a direction A1 on a conveying passage between the belts 81 and 82 and in a direction A2 on a conveying passage between the belts 82 and 83.

Paper money carried on the conveying passage between the belts 81 and 82 passes through a pair of guide plates 84 and advances in a direction A6 to be supplied to the ATM 1. On the other hand, paper money recovered from the ATM 1 is carried in a direction A7 to pass through a pair of guide plates 85 and advances through the conveying passage between the belts 82 and 83 to be recovered in the direction A2. Three rollers 77, 78 and 79 are vertically arranged and rotated in directions as shown by corresponding arrows for applying advancing forces to paper money passing through between the guide plates 84 and between the guide plates 85.

The coupling means shown in FIG. 10 is, as a whole, pivotal about an axis J1 in directions A3 and A4. Further, a tip portion of the coupling means where the guide plates 84, 85 are provided are pivotal about an axis J2 in directions A5. By allowing the guide plates 84, 85 to be pivotal in the forward-rearward directions and in the vertical directions as described above, the positioning of the coupling means is precisely achieved, which will be described later.

For achieving the precise positioning of the coupling means, a positioning roller 91 is supported on a frame (not shown) of the coupling means via an arm 92.

On the other hand, a positioning guide 93 is mounted to the ATM 1 for receiving the positioning roller 91.

Figure 11:
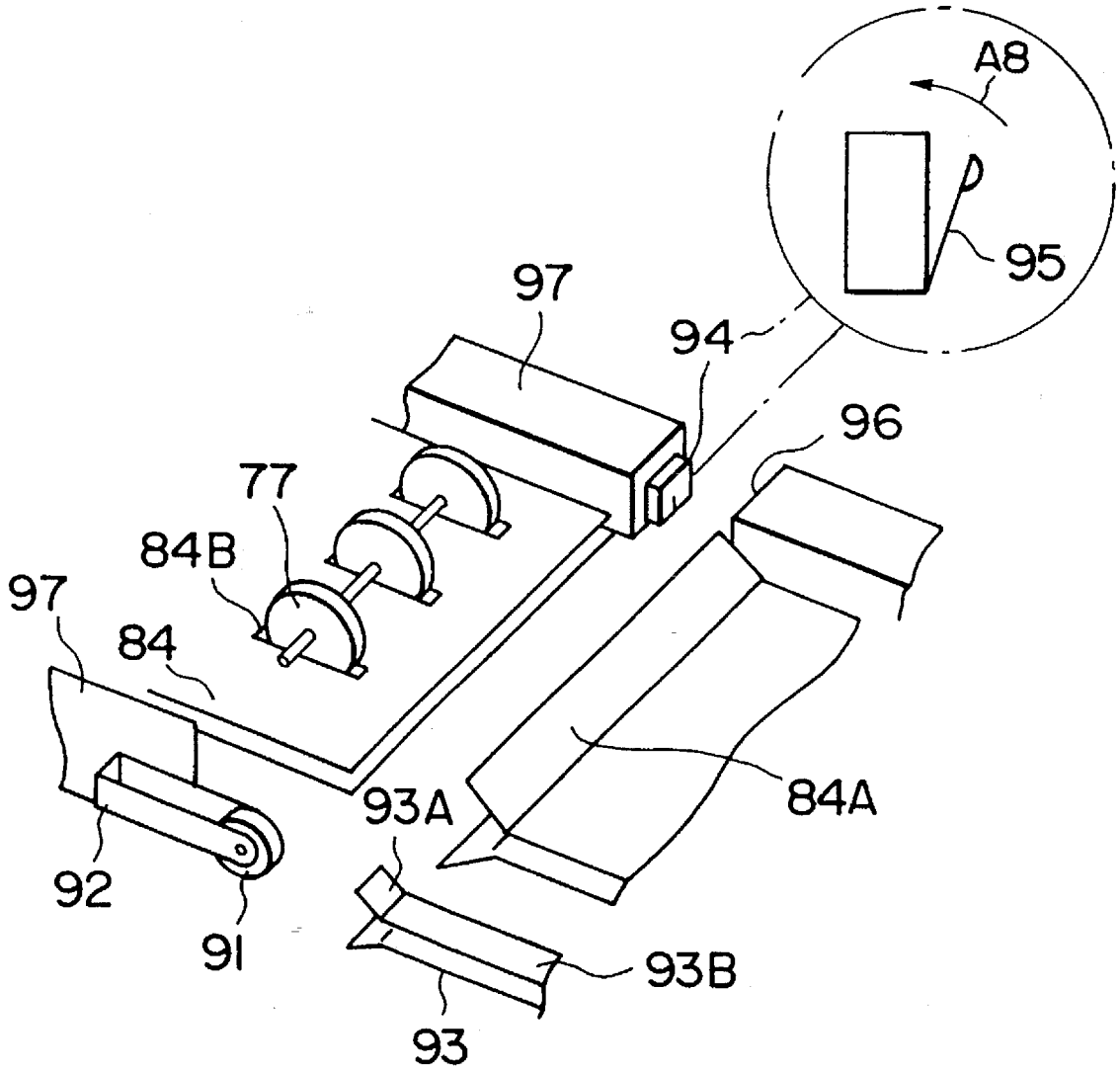
FIG. 11 is a perspective view showing the main portion of the coupling means according to the second preferred embodiment.

FIG. 11 is a perspective view showing the main portion of the coupling means.

In order to make clearer the structures of the positioning roller 91, the positioning guide 93 and the like, the coupling portions are shown in a perspective view in FIG. 11.

In slits 84B formed in the guide plate 84 are disposed the rollers 77 each partially projecting downward. On both sides of the guide plates 84 is arranged a frame 97. In FIG. 11, the positioning roller 91 is supported on the frame 97 via the arm 92. The roller 91 is rotatably mounted to a tip of the arm 92 so as to be smoothly received in the guide 93. The arm 92 is firmly fixed to the frame 97.

On the other hand, guide plates 84A are mounted to the ATM 1 for receiving therein the tip portion of the guide plates 84 of the coupling means.

Further, a limit switch 94 is fixed to a tip end of the frame 97 at a side remote from the positioning roller 91. The limit switch 94 has a pin 95 as shown on an enlarged scale in a circle in FIG. 11 and is arranged to be set ON by displacing the pin 95 in a direction A8. A coupling detection surface 96 is provided on the ATM side so as to confront the limit switch 94. Accordingly, when the coupling means moves toward the ATM 1 to cause the pin 95 to be pressed by the coupling detection surface 96 in the direction A8, the limit switch turns ON so that the precise positioning of the coupling means is detected by monitoring an output of the limit switch 94. In this regard, the limit switch is precisely located at a given position on the frame 97 confronting the coupling detection surface 96 and with a given distance from the coupling detection surface 96.

When the coupling of the coupling means is started, the roller 91 is first received in an opening 93A of the guide 93. At this time, even when a position of the roller 91 is vertically offset to a degree, a size of the opening 93A of the guide 93 is selected so as to smoothly receive the guide 93 therein. On the other hand, when the roller 91 advances deep into the guide 93 so as to complete the coupling of the coupling means, the roller 91 should be precisely positioned and held. Accordingly, an interval between upper and lower plates forming the guide 93 is so selected at the deepest portion 93B of the guide 93 as to precisely position the roller 91.

Figure 12:
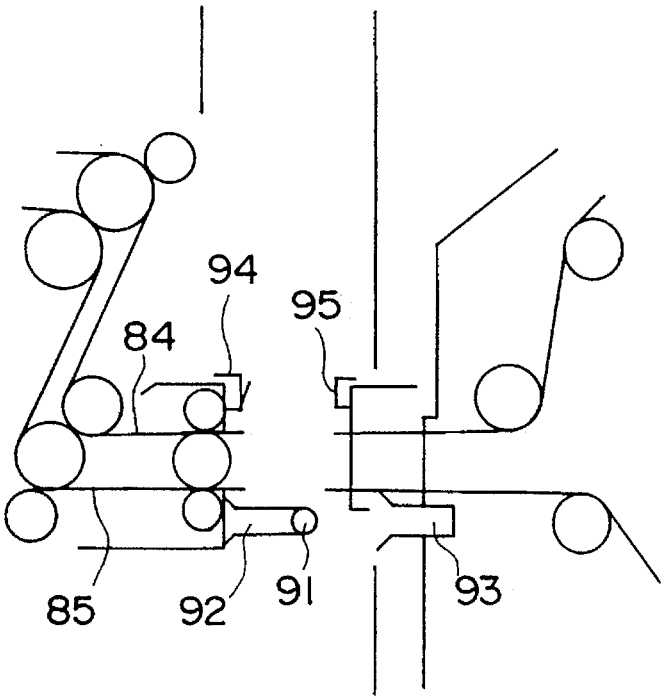
FIG. 12 is a diagram for explaining operations of coupling detection and positioning means, wherein a state before coupling of the coupling means is shown.
Figure 13:
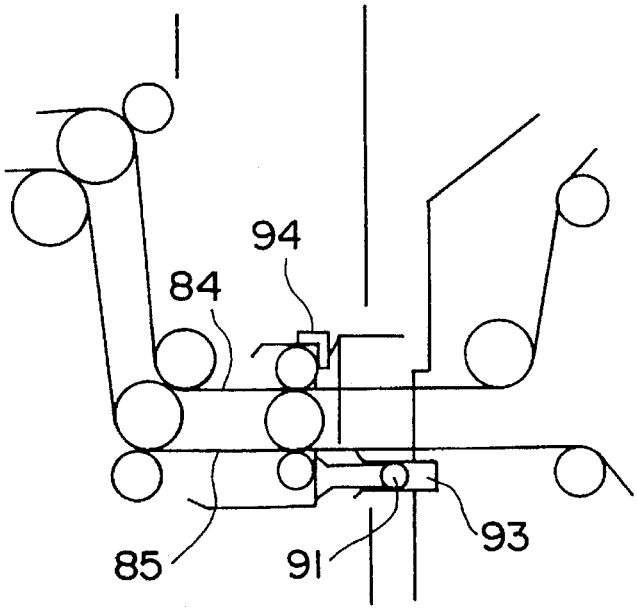
FIG. 13 is a diagram for explaining the operations of the coupling detection and the positioning means, wherein a state after the coupling of the coupling means is shown.

FIGS. 12 and 13 are diagrams, respectively, for explaining operations of the coupling detection and the positioning means. FIG. 12 shows a state before the coupling of the coupling means, while FIG. 13 shows a state after the coupling of the coupling means.

In the state shown in FIG. 10, when the coupling means is turned in the direction A4 to advance the guide plates 84 in the direction A6, the roller 91 is received in the guide 93. When the guide plates 84 are further advanced in the direction A6, a vertical position of the guide plates 84 is precisely determined by means of the guide 93 so that the guide plates 84 are coupled with the guide plates 84A.

As shown in FIG. 10, since the coupling means is vertically pivotal, the precise positioning of the coupling means is accomplished by the movement of the roller 91.

Figure 14:
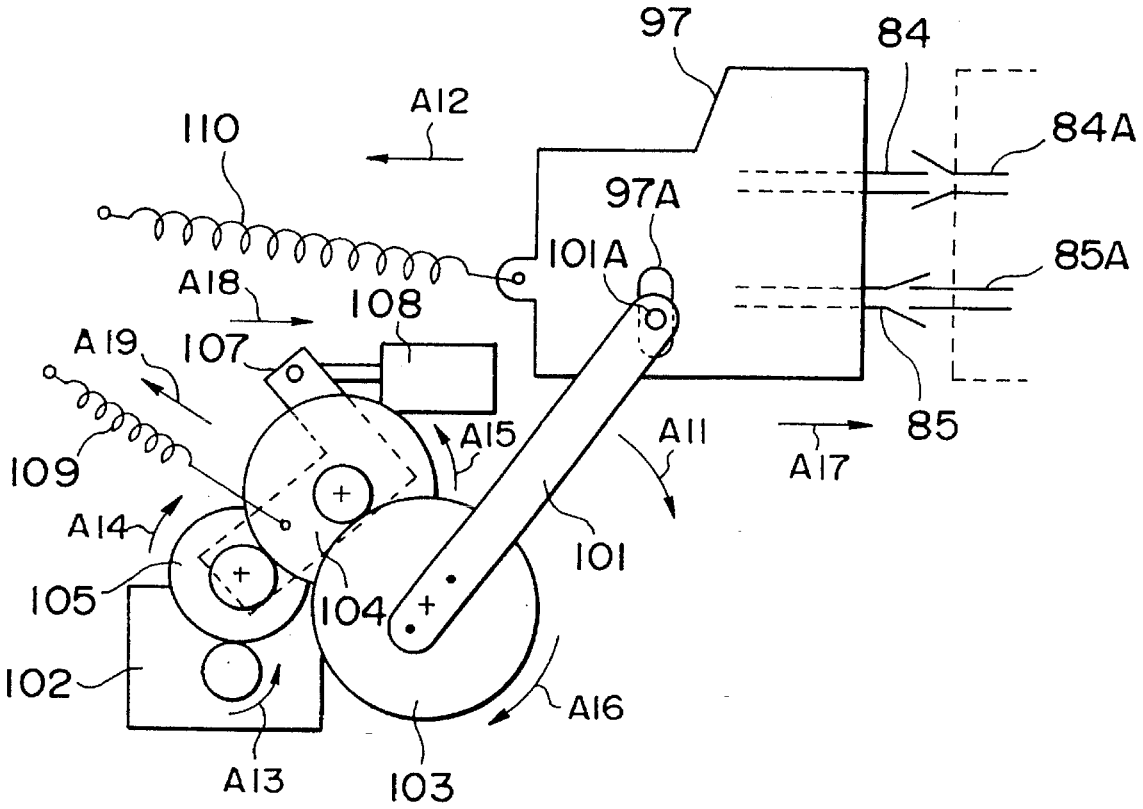
FIG. 14 is a side view showing the coupling means according to the second preferred embodiment.

FIG. 14 is a side view of the coupling means.

As shown in FIG. 14, the tip portions of the guide plates 84 and 85 are projected from the frame 97 of the coupling means. An elongate hole 97A is formed in the frame 97. A pin 101A fixed to an arm 101 is slidably received in the elongate hole 97A. The arm 101 is firmly fixed to a gear 103 and arranged to turn in a direction A11 in response to rotation of the gear 103 in a direction A16. This turning action of the arm 101 causes the frame 97 to advance in a direction A17 so that the foregoing coupling operation is performed.

The gear 103 is connected to a motor 102 via a gear 104 and a gear 105. Specifically, a drive force of the motor 102 is transmitted to the arm 101 via these gears 103, 104 and 105 and causes the arm 101 to make the turning action. For example, when the motor 102 is rotated in a direction A13, the gear 105 rotates in a direction A14 to cause the gear 104 to rotate in a direction A15. This causes the gear 103 to rotate in the direction A16.

On the other hand, when the frame 97 is displaced in a direction opposite to the direction A17 so as to release the coupling of the coupling means, the motor 102 is rotated in a direction opposite to the direction A13.

As appreciated, when some serious problem occurs in the carrier 2 or the ATM 1, the coupling therebetween should be released. On the other hand, when, for example, such a serious problem occurs in the carrier 2, it is possible that the motor 102 can not be smoothly driven. The structure shown in FIG. 14 has a mechanism which can easily separate the coupling means from the ATM 1 in such an accidental case.

Specifically, the gears 105 and 104 which transmit the drive force from the motor 102 to the gear 103 are supported on a bearing plate 107, respectively. The bearing plate 107 is urged in a direction A19 by a biasing force of a return spring 109. When the system is normally operated so that the drive force of the motor 102 is transmitted to the gear 103, a solenoid 108 pulls the bearing plate 107 in a direction opposite to the direction A19. On the other hand, when something abnormal occurs, the solenoid stops pulling the bearing plate 107. This causes the return spring 109 to force the gears 104 and 105 in the direction A19 so that the gear 104 is separated from the gear 103. Accordingly, the gear 103 is released. On the other hand, a return spring 110 is connected to the frame 97 to urge the frame 97 in a direction A12. Accordingly, when the gear 103 is released, the frame 97 is forced in the direction A12 by a biasing force of the return spring 110 so that the coupling of the coupling means is released.

CLOSING AND OPENING OF CONVEYING PASSAGES

Figure 15A:
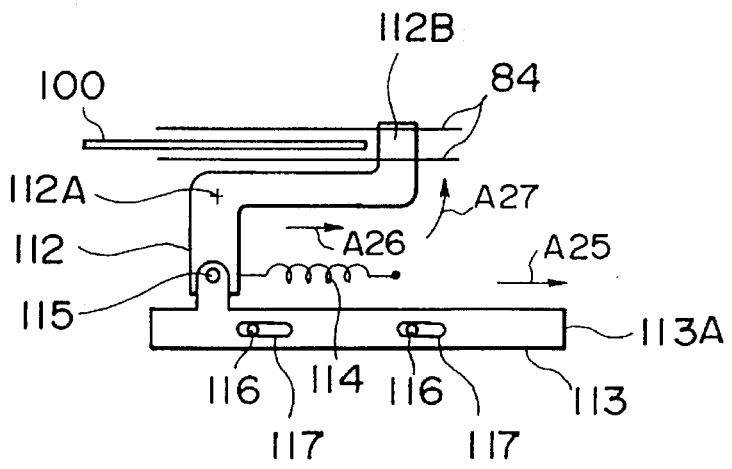
FIG. 15A is a side view showing a slide arm and a shutter in a state to close a conveying passage according to the second preferred embodiment.
Figure 15B:
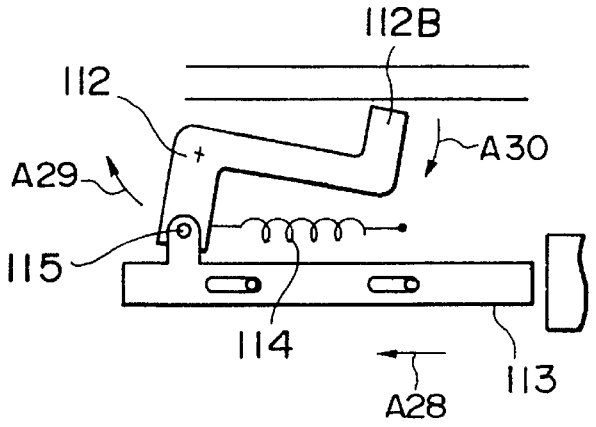
FIG. 15B is a side view showing the slide arm and the shutter in a state to open the conveying passage according to the second preferred embodiment.
Figure 15C:
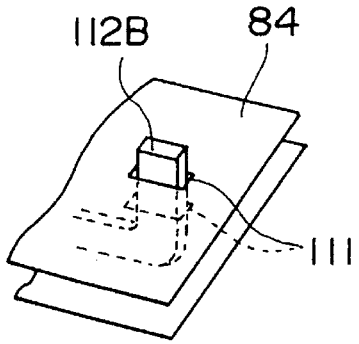
FIG. 15C is a perspective view showing an engaging state of the shutter and guide plates to close the conveying passage according to the second preferred embodiment.

FIG. 15A is a side view showing a slide arm and a shutter in a state to close the paper money conveying passage according to the second preferred embodiment, FIG. 15B is a side view showing the slide arm and the shutter in a state to open the paper money conveying passage according to the second preferred embodiment, and FIG. 15C is a perspective view showing an engaging state of the shutter and the guide plates to close the paper money conveying passage according to the second preferred embodiment.

When or after the coupling means is separated from the ATM 1, it is essential to prevent paper money from falling off between the ATM 1 and the carrier 2. The structure shown in FIGS. 15A to 15C provides a mechanism for prohibiting such falling-off of paper money.

As shown in the figures, the upper and lower guide plates 84 are formed with through holes 111, respectively. A tip portion 112B of a shutter 112 passes through these through holes 111. The shutter 112 is pivotally supported about an axis 112A in a direction A27.

A slide arm 113 is supported below the shutter 112 by means of pins 116 received in elongate holes 117 formed in the slide arm 113. The slide arm 113 is slidable in a direction A25 through engagement between the pins 116 and the elongated holes 117. A tip portion 113A is projected in a gap at the coupling portion of the coupling means with a projecting length being variable depending on a length of the gap. To a base portion of the slide arm 113 is coupled the shutter 112 via a link 115. Further, the shutter 112 is urged by a biasing force of a spring 114 in a direction A26 so as to turn in the direction A27.

Accordingly, when no external force is applied, as shown in FIG. 15A, the slide arm 113 is projected in the direction A25 to the maximum degree, and the tip portion 112B of the shutter 112 is inserted into the through holes 111 of the guide plates 84 so as to prohibit paper money 100 from moving between the guide plates 84. Accordingly, by providing this mechanism at the coupling portions between the coupling means and the ATM 1, paper money 100 is held in such a state as to be prevented from falling off to the exterior.

On the other hand, in the state shown in FIG. 15B, paper money 100 is allowed to advance between the guide plates 84.

Specifically, when the slide arm 113 is pressed in a direction A28, the slide arm 113 slides in that direction to turn the shutter 112 in a direction A29 via the link 115. This causes the tip portion 112B of the shutter 112 to be withdrawn from between the guide plates 84 so that paper money 100 can be transferred.

It is effective to mount the shutters 112 and the slide arms 113 to those guide plates, respectively, from which paper money is sent out into the counter guide plates. However, it may be possible to mount them to the counter guide plates, respectively.

When the normal coupling is achieved as shown in FIG. 13, the slide arm 113 is pressed to slide in the direction A28 so as to turn the shutter 112 in the direction A29 to open the paper money conveying passage as shown in FIG. 15B.

On the other hand, when the coupling between the carrier 2 and the ATM 1 is released, the slide arm 113 slides in the direction A25 to turn the shutter 112 in the direction A27 so as to close the paper money conveying passage as shown in FIG. 15A.

Accordingly, when, for example, the carrier 2 is separated from the ATM 1 due to a certain problem raised, the conveying passage between the guide plates is automatically closed to prevent paper money from falling off.

With the foregoing structure of the coupling means, the roller 91 works to precisely position the coupling portions so as to achieve the reliable coupling of the carrier 2 and the ATM 1 via the coupling means. Further, the limit switch 94 works to detect the coupling detection surface 96 and to determine whether a distance therebetween is appropriate.

Further, when some trouble occurs in the carrier 2 or the ATM 1, the solenoid 108 shown in FIG. 14 is forcibly released. This causes the frame 97 to move in the direction away from the ATM 1 so that the coupling of the paper money conveying passages is automatically released.

As appreciated, the solenoid 108 may also be released to separate the conveying passages when a trouble other than the foregoing is detected.

Further, when the coupling portion of the coupling means is separated from the ATM 1, the slide arm and the shutter shown in FIGS. 15A to 15C detect it so as to close the conveying passage for preventing paper money from falling off.

As appreciated from the foregoing description, the foregoing mechanisms cooperatively assist the paper money supply-recovery operations of the carrier 2 so as to realize the smooth ATM managing system.

Further, the associated elements at the coupling portions between the ATM 1 and the carrier 2 shown in FIGS. 4 and 10 to 15 may be provided at either the ATM 1 or the carrier 2.

Further, a pair of the conveying passages for the paper money supply and recovery in the coupling means may be replaced by one conveying passage where paper money is conveyed in both directions. In this case, the blades may be switched by the blade switching means correspondingly.

Further, the centralized control unit 3 may be formed in the carrier.

Further, in the foregoing preferred embodiments, a pair of the paper money containers are arranged in the carrier in the vertical direction, that is, in a direction perpendicular to a moving direction of the carrier. On the other hand, a further pair of the paper money containers may be arranged in the lateral direction, that is, in parallel with the moving direction of the carrier. With this arrangement, when the paper money supply-recovery operation can not be performed relative to one pair of the containers, the other pair of the containers may be used for the supply-recovery operation.

Further, the medium handled by the system is not limited to paper money, but may cover either of various mediums which are used in the ATM.

It is to be understood that this invention is not to be limited to the preferred embodiments and modifications described above, and that various changes and modifications may be made without departing from the spirit and scope of the invention as defined in the appended claims.

What is claimed is:

1. An automatic teller machine managing system having an automatic teller machine and a carrier for exchanging a medium with the automatic teller machine, said automatic teller machine managing system comprising:

moving means for moving said carrier;

coupling means movably arranged and coupling said carrier and said automatic teller machine; and carrying means for carrying, via said coupling means, said medium one by one from said carrier to said automatic teller machine or from said automatic teller machine to said carrier;

wherein said coupling means includes a supply passage for supplying said medium from said carrier to said automatic teller machine and a recovery passage for recovering said medium from said automatic teller machine to said carrier, and wherein each of said supply passage and said recovery passage is formed by a pair of plates and includes a first passage supported on a side of said carrier and a second passage supported on a side of said automatic teller machine.

2. The managing system as set forth in claim 1, wherein said coupling means includes a shutter mechanism for setting a conveying passage of said coupling means to an opened state when said carrier and said automatic teller machine are coupled with each other and for setting said conveying passage to a closed state when said carrier and said automatic teller machine are detached from each other.

3. The managing system as set forth in claim 1, wherein said coupling means includes a supply passage for supplying the medium from said carrier to said automatic teller machine and a recovery passage for recovering the medium from said automatic teller machine to said carrier, and wherein said carrier includes a supply medium accumulating section for accumulating the medium to be sent to said supply passage and a recovery medium accumulating section for accumulating the medium sent from said recovery passage.

4. The managing system as set forth in claim 3, wherein said carrier includes a discriminator, supply medium carrying means for carrying the medium in said supply medium accumulating section to said discriminator, recovery medium carrying means for carrying the medium in said recovery medium accumulating section to said discriminator, and detecting means for detecting an amount of the medium held in said carrier based on a discrimination result at said discriminator.

5. The managing system as set forth in claim 4, wherein said recovery medium carrying means carries the medium to said discriminator after transferring the medium to said supply medium accumulating section.

6. The managing system as set forth in claim 5, wherein said medium is paper money and said medium amount is the number of paper money per kind.

7. The managing system as set forth in claim 1, wherein one of said first and second passages moves horizontally.

8. The managing system as set forth in claim 7, wherein one of said first and second passages is enlarged at a tip thereof.

9. The managing system as set forth in claim 7, wherein said coupling means further includes means for forcibly returning said one of the first and second passages to an initial position.

10. The managing system as set forth in claim 7, further comprising detecting means for detecting a given positional relationship between tips of said first and second passages.

11. The managing system as set forth in claim 10, further comprising prohibiting means for prohibiting a horizontal movement of said one of the first and second passages and moving means for vertically moving said one of the first and second passages, whereby said first and second passages are positioned at a given position by said prohibiting and moving means.

12. The managing system as set forth in claim 7, wherein said first passages supported on the side of said carrier move horizontally.

13. The managing system as set forth in claim 12, wherein said coupling means includes a frame supporting said first passages and moving means for horizontally moving said frame.

14. The managing system as set forth in claim 13, wherein said coupling means includes a frame supporting said first passages, a drive source and transmitting means for transmitting a driving force from said drive source to said frame.

15. The managing system as set forth in claim 14, wherein said coupling means includes disconnecting means for disconnecting said driving force and biasing means for biasing said frame to an initial position.

16. The managing system as set forth in claim 14, wherein said transmitting means includes an arm having one end supported on said frame and the other end supported on a first gear, a second gear detachably supported on said first gear and transmitting the driving force of said drive source to said first gear, means for separating said first gear from said second gear, and biasing means for biasing said frame to an initial position.

* * * * *